US005732141A

United States Patent [19]

Chaoui et al.

[11] Patent Number: 5,732,141

[45] Date of Patent: Mar. 24, 1998

[54] DETECTING VOICE ACTIVITY

[75] Inventors: Jamil Chaoui, Courbevoie; Ivan Bourmeyster, Paris; Francois Robbe, Cormeilles-En-Parisis, all of France

[73] Assignee: Alcatel Mobile Phones, Paris, France

[21] Appl. No.: 560,645

[22] Filed: Nov. 20, 1995

[30] Foreign Application Priority Data

Nov. 22, 1994 [FR] France ..... 94 13962

[51] Int. Cl.[6] ..... H04R 29/00

[52] U.S. Cl. ..... 381/56; 395/2.42

[58] Field of Search ..... 381/56, 66, 58; 395/2.26, 2.42, 2.46, 2.4; 379/388, 389, 390, 410, 411, 412

[56] References Cited

U.S. PATENT DOCUMENTS

| | | | |
|---|---|---|---|
| 3,919,479 | 11/1975 | Moon et al. | 395/2.46 |
| 4,282,405 | 8/1981 | Taguchi | 395/2.26 |
| 4,426,551 | 1/1984 | Domatsu et al. | 395/2.46 |
| 4,715,065 | 12/1987 | Parker | 395/2.42 |
| 4,720,802 | 1/1988 | Damoulakis et al. | 395/2.42 |
| 4,797,931 | 1/1989 | Furukawa et al. | 381/56 |
| 4,815,137 | 3/1989 | Benvenuto | 381/43 |
| 4,872,724 | 10/1989 | Satoh et al. | 395/2.26 |
| 5,276,765 | 1/1994 | Freeman et al. | 395/2.42 |
| 5,410,632 | 4/1995 | Hong et al. | 395/2.42 |

FOREIGN PATENT DOCUMENTS

| | | |
|---|---|---|
| 0123349A1 | 10/1984 | European Pat. Off. . |
| 0335521A1 | 10/1989 | European Pat. Off. . |

OTHER PUBLICATIONS

K. S. Rafila et al, "Voiced/Unvoiced/Mixed excitation classification of speech using the autocorrelation of the output of an adpcm system", *IEEE International Conference On Systems Engineering*, Aug. 24, 1989, Fairborn, Ohio, pp. 537–540.

*Primary Examiner*—Curtis Kuntz
*Assistant Examiner*—Vivian Chang
*Attorney, Agent, or Firm*—Sughrue, Mion, Zinn, Macpeak & Seas, PLLC

[57] ABSTRACT

Method and apparatus for detecting voice activity in an audio signal, the method comprising computing the autocorrelation coefficients of the signal, identifying a first autocorrelation vector whose components comprise a first series of autocorrelation coefficients, identifying a second autocorrelation vector whose components comprise a second series of autocorrelation coefficients offset from the first series by a predetermined offset value, subtracting the first autocorrelation vector from the second autocorrelation vector to obtain a differentiation vector, and computing a norm of the differentiation vector, which differentiation vector norm represents a first indicator of voice activity.

14 Claims, 1 Drawing Sheet

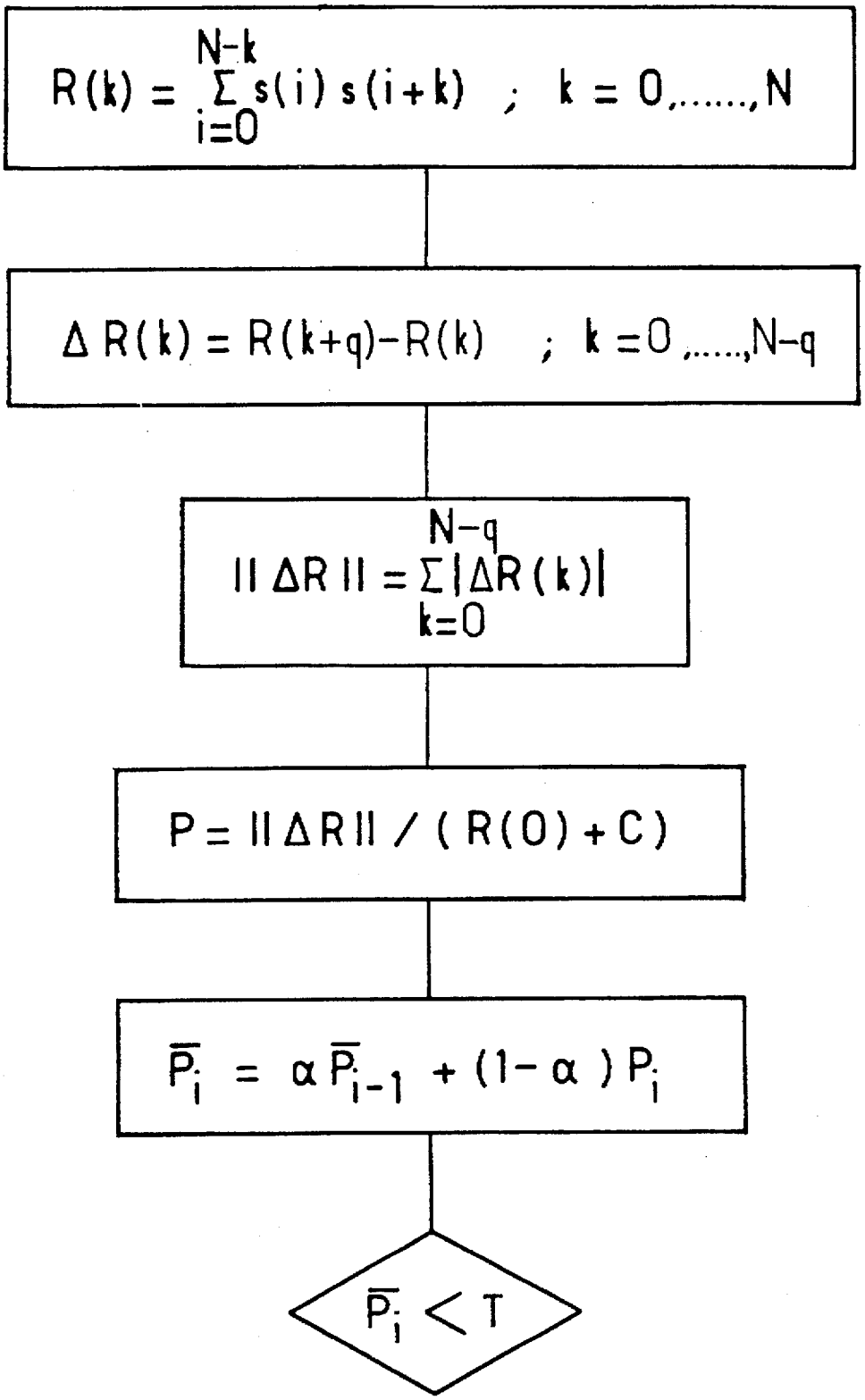
$R(k) = \sum_{i=0}^{N-k} s(i)\, s(i+k) \quad ; \quad k = 0, \ldots\ldots, N$
$\Delta R(k) = R(k+q) - R(k) \quad ; \quad k = 0, \ldots\ldots, N-q$
$\| \Delta R \| = \sum_{k=0}^{N-q} |\Delta R(k)|$
$P = \| \Delta R \| / (R(0) + C)$
$\overline{P}_i = \alpha \overline{P}_{i-1} + (1-\alpha) P_i$
$\overline{P}_i < T$

DETECTING VOICE ACTIVITY

The field of the invention is that of detecting voice activity in an audio signal.

BACKGROUND OF THE INVENTION

In the presence of an audio signal, often coming from a microphone, it is sometimes necessary to establish whether the signal contains speech or whether it comprises noise only.

The detection of voice activity is often used to determine particular treatments to be applied to the audio signal. Typical applications that may need to be activated in the presence of a speech signal include speech recognition, echo cancelling, or indeed recording.

If the audio signal is being used in telephony where speech is considered to be the only kind of useful signal, it is now common practice in the field of radiocommunications to cease transmitting the signal if it comprises noise only, and this is commonly called discontinuous transmission.

Thus, techniques have already been proposed for attempting to detect voice activity in an audio signal.

A first technique consists in tracking energy variations in the signal. If energy increases rapidly, that may correspond to the appearance of voice activity, however it may also correspond to a change in background noise. Thus, although that method is very simple to implement, it is not very reliable in relatively noisy environments, such as in a motor vehicle, for example.

Numerous other techniques are known that have been developed for mitigating the above lack of reliability. This applies in particular to techniques that implement a Fourrier transform of the audio signal to measure the spectral distance between it and an averaged noise signal which is updated in the absence of any voice activity. This also applies to methods using sub-band analysis of the signal, which methods are close to those that use a Fourrier transform. The same applies to methods that make use of cepstrum analysis.

Those techniques are much more complex, and although they improve the level of reliability they still do not provide complete satisfaction on this point.

Techniques are also known that take advantage of certain periodicity in speech, and one such is described in European patent application EP 0 123 349. All voiced sounds have determined periodicity whereas noise is usually aperiodic, or if periodic, its periodicity is different from that of speech.

It is therefore possible to look for the pitch of this determined periodicity in order to recognize the presence of voiced sounds.

For this purpose, autocorrelation coefficients of the audio signal are generally computed in order to seek the second maximum of such coefficients, where the first maximum represents energy. That is another relatively complex technique which does not give complete satisfaction on reliability.

OBJECTS AND SUMMARY OF THE INVENTION

The present invention therefore proposes a technique for detecting voice activity which provides acceptable reliability for reduced complexity.

According to the invention, apparatus for detecting voice activity in an audio signal comprises:

means for computing the autocorrelation coefficients of the signal;

means for identifying a first autocorrelation vector whose components comprise a first series of autocorrelation coefficients;

means for identifying a second autocorrelation vector whose components comprise a second series of autocorrelation coefficients offset from said first series by a predetermined offset value;

means for subtracting said first autocorrelation vector from said second autocorrelation vector to obtain a differentiation vector; and means for computing a norm of said differentiation vector, which differentiation vector norm represents a first indicator of voice activity.

In addition, the apparatus further comprises reduction means for establishing a reduced norm by dividing said differentiation vector norm by a reduction value, said reduced norm representing a second indicator of voice activity.

By way of example, said reduction value is equal to the energy of the audio signal or else it is equal to the sum of the energy of the audio signal plus a floor value.

According to an additional characteristic, the apparatus includes means for smoothing one of said voice activity indicators to produce a linear combination of the present value of said indicator and its preceding value, said linear combination representing a third indicator of voice activity.

Also, the apparatus includes decision means for producing a voice activity signal if any one of said indicators exceeds a detection threshold.

It may be advantageous to establish this detection threshold on the basis of the energy in the audio signal in the absence of the voice activity signal.

An advantageous technique also consists in selecting the sum of the absolute values of the components of the differentiation vector as the norm of the vector.

The invention also provides a method of detecting voice activity in an audio signal, the method comprising the following operations:

computing the autocorrelation coefficients of the signal;

identifying a first autocorrelation vector whose component comprise a first series of autocorrelation coefficients;

identifying a second autocorrelation vector whose components comprise a second series of autocorrelation coefficients offset from said first series by a predetermined offset value;

subtracting said first autocorrelation vector from said second autocorrelation vector to obtain a differentiation vector; and computing a norm of said differentiation vector, which differentiation vector norm represents a first indicator of voice activity.

BRIEF DESCRIPTION OF THE DRAWING

The present invention appears more clearly below in the context of an embodiment given by way of illustration and with reference to the accompanying FIGURE which is a flow chart of the operations performed by the apparatus for detecting voice activity.

MORE DETAILED DESCRIPTION

The description refers to an audio signal which is digital, i.e. it is in the form of a sequence of samples each corresponding to the value of the signal at successive instants that recur at a sampling frequency.

When the signal to be analyzed is an analog signal, e.g. coming from a microphone, it is initially applied to an analog-to-digital converter operating at the sampling frequency so as to produce the audio signal.

Since the audio signal is digital, it seems natural to implement the voice activity detection apparatus by means of a digital signal processor. The processor could naturally also be used for other purposes.

It will thus be understood that the detection apparatus is not described structurally since it implements elementary operations that are well known to the person skilled in the art such as additions, multiplications, and comparisons. The description is therefore functional, since that seems by far the best way of explaining implementation of the invention clearly.

With reference to the sole FIGURE, the apparatus therefore receives the audio signal and consideration is given to a series of samples S(i) where i lies in the range O to N.

The first operation performed by the apparatus is to compute the autocorrelation coefficients R(k) of the signal for all values of a lying in the range 0 to N:

$$R(k)=\sum_{i=0}^{N-k} S(i)S(i+k)$$

From these autocorrelation coefficients R(k), it is possible to define first and second autocorrelation vectors $R_O$ and $R_q$ by also taking into account an offset value q which is a positive integer. The first autocorrelation vector $R_o$ has as its components the (N−q+1) first autocorrelation coefficients R(k):

$$R_0=(R(0), R(1) \ldots, R(n-q))$$

The second autocorrelation vector $R_q$ has the (N−q+1) last autocorrelation coefficients R(k) as its components:

$$R_q=(R(q), R(q+1) \ldots, R(N))$$

The detection apparatus then computes a differentiation vector ΔR by subtracting the first autocorrelation vector $R_O$ from the second autocorrelation vector $R_q$:

$$\Delta R=R_q-R_0$$

If the (k+1)th component of this differentiation vector is written ΔR(k), then the following applies for all k in the range 0 to N−q:

$$\Delta R(k)=R(k+q)-R(k)$$

It can be seen that the first and second autocorrelation vectors $R_O$ and $R_q$ are not useful in themselves. They are mentioned solely for the purpose of clarifying the description. The important point is to compute the differentiation vector. Thus, this vector is defined by the values of its components as defined above.

The detection apparatus then computes a norm ||ΔR|| of the differentiation vector AR. Advantageously, this norm is equal to the sum of the absolute values of the components of the vector:

$$\|\Delta R\|=\sum_{k=0}^{N-q} |\Delta R(k)|$$

It goes without saying that the invention applies equally well if some other norm is chosen, such as, in particular, the Euclidean norm or the maximum value of the absolute values of each of the components.

This norm, whatever it may be, constitutes a first indicator of voice activity.

A first option consists in comparing this indicator with a threshold to establish that voice activity is present in the audio signal if the indicator is greater than the threshold.

In a second option, the detection apparatus computes a reduced norm P by dividing the differentiation vector norm ||ΔR|| by a reduction value. By way of example, this reduction value may be selected to be equal to the energy R(0) of the audio signal, thereby tending to compress the dynamic range of the norm Another solution that provides its own specific advantages consists in using as the reduction value the sum of the energy R(0) of the audio signal plus a constant which we call the "floor" value C.

In any event, this reduced norm P constitutes a second indicator of voice activity that can likewise be compared with a threshold to establish the absence or presence of voice activity in the signal.

In a third option, the detection apparatus proceeds by smoothing the reduced norm. Thus, if a plurality of successive series of N samples of the audio signal are taken into consideration, a reduced norm $\overline{P}_i$ corresponds to the i-th series. The smoothed value $P_i$ of this reduced norm will be a linear combination of the smoothed value $\overline{P}_{i-1}$ of the reduced norm $P_{i-1}$ associated with the preceding series and of said reduced norm $P_i$:

$$\overline{P}_i=\alpha\overline{P}_{i-1}+\beta P_i$$

α and β can be chosen so that their sum is equal to unity.

In addition, it is appropriate to initialize $\overline{P}_O$ with an arbitrary constant, e.g. 0.

This smoothed value $\overline{P}_i$ constitutes a third indicator of voice activity which can also be compared with a threshold to establish whether or not the audio signal presents voice activity.

Whichever indicator of voice activity is used, the detection apparatus thus compares it with a detection threshold T. The simplest technique consists in giving this detection threshold a constant value.

However, an advantageous technique consists in adapting the threshold to the level of the reduced norm P whenever the audio signal is lacking in voice activity.

It is thus possible to calculate the mean value of the reduced norm over a plurality of successive series of samples of the audio signal for which no voice activity has been detected and to multiply the mean value by a constant coefficient so as to obtain the detection threshold P. This constitutes a technique that is analogous to the smoothing technique that is well known to the person skilled in the art, and it is therefore not described in greater detail.

In addition to detection apparatus as apparatus, the invention naturally also relates to the voice activity detection method implemented by the apparatus.

By way of numerical example and to give a concrete use for the invention, the pan-European digital cellular radiocommunications system known as GSM is used as an illustration. In that system, the analog signal to be processed is sampled at a frequency of 8 kHz. The samples obtained in this way are collected together in series of 160 samples, so each series corresponds to 20 ms.

Thus, the number of samples N is equal to 160 and the offset value q is advantageously set at unity.

The components of the differentiation vector are then written as follows for all k lying in the range 1 to 160.

$$\Delta R(k)=R(k+1)-R(k)$$

The norm of this vector can therefore be written:

$$\|\Delta R\| = \sum_{k=0}^{159} |\Delta R(k)|$$

We claim:

1. An apparatus for detecting voice activity in an audio signal, the apparatus comprising:

means for computing a set of consecutive autocorrelation coefficients ($R_k$, $0 \leqq k \geqq N$), of the signal;

means for identifying a first autocorrelation vector whose components comprise a first series of said set of consecutive autocorrelation coefficients;

means for identifying a second autocorrelation vector whose components comprise a second series of said set of consecutive autocorrelation coefficients offset from said first series by a predetermined value of k;

means for subtracting said first autocorrelation vector from said second autocorrelation vector to obtain a differentiation vector; and means for computing a differentiation vector norm from said differentiation vector, said differentiation vector norm representing a first indicator of voice activity.

2. An apparatus according to claim 1, further comprising reduction means for dividing said first indicator of voice activity by a reduction value to obtain a second indicator of voice activity.

3. An apparatus according to claim 2, wherein said reduction value is equal to the energy of the audio signal.

4. An apparatus according to claim 2, wherein said reduction value is equal to the sum of the energy of the audio signal plus a floor value.

5. An apparatus according to claim 2, including means for smoothing one of said voice activity indicators to produce a linear combination of the present value of said indicator and its preceding value, said linear combination representing a third indicator of voice activity.

6. An apparatus according to claim 5, including decision means for producing a voice activity signal if any one of said indicators exceeds a detection threshold.

7. An apparatus according to claim 6, wherein said detection threshold is established on the basis of the value of the second indicator of voice activity of said audio signal in the absence of said voice activity signal.

8. An apparatus according to claim 1, wherein said first indicator of voice activity is equal to the sum of the absolute values of the components of said differentiation vector.

9. The apparatus for detecting voice activity in an audio signal of claim 1, wherein said predetermined value of k is equal to a predetermined number of consecutive autocorrelation coefficients.

10. The apparatus for detecting voice activity in an audio signal of claim 1, wherein said first autocorrelation vector and said second autocorrelation vector each comprise a plurality of autocorrelation coefficients.

11. The apparatus for detecting voice activity in an audio signal of claim 1, wherein said first autocorrelation vector begins with a first autocorrelation coefficient of said set of autocorrelation coefficients and said second autocorrelation vector ends with a last autocorrelation coefficient of said set of autocorrelation coefficients.

12. A method of detecting voice activity in an audio signal, the method comprising the following operations:

computing a set of consecutive autocorrelation coefficients ($R_k$, $0 \leqq k \geqq N$), of the signal;

identifying a first autocorrelation vector whose components comprise a first series of said set of consecutive autocorrelation coefficients;

identifying a second autocorrelation vector whose components comprise a second series of said set of consecutive autocorrelation coefficients offset from said first series by a predetermined value of k;

subtracting said first autocorrelation vector from said second autocorrelation vector to obtain a differentiation vector; and computing from said differentiation vector a differentiation vector norm which is a first indicator of voice activity.

13. An apparatus for detecting voice activity in an audio signal, the apparatus comprising:

means for computing a set of consecutive autocorrelation coefficients ($R_k$, $0 \leqq k \geqq N$), of the signal;

means for identifying a first autocorrelation vector whose components comprise a first series of said set of consecutive autocorrelation coefficients;

means for identifying a second autocorrelation vector whose components comprise a second series of said set of consecutive autocorrelation coefficients offset from said first series by a predetermined value of k;

means for subtracting said first autocorrelation vector from said second autocorrelation vector to obtain a differentiation vector;

means for computing from said differentiation vector a first indicator of voice activity; and means for smoothing said voice activity indicator to produce a linear combination of the present value of said indicator and its preceding value, said linear combination representing a further indicator of voice activity.

14. An apparatus for detecting voice activity in an audio signal, the apparatus comprising:

means for computing a set of consecutive autocorrelation coefficients ($R_k$, $0 \leqq k \geqq N$), of the signal;

means for identifying a first autocorrelation vector whose components comprise a first series of said set of consecutive autocorrelation coefficients;

means for identifying a second autocorrelation vector whose components comprise a second series of said set of consecutive autocorrelation coefficients offset from said first series by a predetermined value of k;

means for subtracting said first autocorrelation vector from said second autocorrelation vector to obtain a differentiation vector; and means for computing from said differentiation vector a first indicator of voice activity, said first indicator of voice activity being equal to the sum of the absolute values of the components of said differentiation vector.

* * * * *